US009138879B2

(12) United States Patent
Keskiniva et al.

(10) Patent No.: US 9,138,879 B2
(45) Date of Patent: Sep. 22, 2015

(54) METHOD AND ARRANGEMENT FOR LUBRICATING DRILL SHANK OF ROCK DRILLING MACHINE

(75) Inventors: Markku Keskiniva, Ylöjärvi (FI); Juha Piispanen, Ylinen (FI); Mauri Esko, Ikaalinen (FI); Aimo Helin, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 494 days.

(21) Appl. No.: 13/574,925

(22) PCT Filed: Jan. 27, 2011

(86) PCT No.: PCT/FI2011/050062

§ 371 (c)(1),
(2), (4) Date: Jul. 24, 2012

(87) PCT Pub. No.: WO2011/092377

PCT Pub. Date: Aug. 4, 2011

(65) Prior Publication Data

US 2012/0292114 A1 Nov. 22, 2012

(30) Foreign Application Priority Data

Jan. 29, 2010 (FI) ..... 20105081

(51) Int. Cl.

| | |
|---|---|
| ***E21B 6/00*** | (2006.01) |
| ***B25D 17/26*** | (2006.01) |
| ***E21B 6/04*** | (2006.01) |
| ***E21B 7/02*** | (2006.01) |

(52) U.S. Cl.

CPC ..... *B25D 17/265* (2013.01); *E21B 6/00* (2013.01); *E21B 6/04* (2013.01); *E21B 7/025* (2013.01)

(58) Field of Classification Search

CPC ..... E21B 6/00; E21B 6/02; E21B 6/04; E21B 6/08

See application file for complete search history.

(56) References Cited

U.S. PATENT DOCUMENTS

| | | | | |
|---|---|---|---|---|
| 4,157,121 | A | 6/1979 | Amtsberg et al. | |
| 4,289,209 | A * | 9/1981 | Salmi | 173/107 |
| 4,934,465 | A * | 6/1990 | Salmi et al. | 173/210 |

(Continued)

FOREIGN PATENT DOCUMENTS

| | | |
|---|---|---|
| FI | 66459 C | 10/1984 |
| FI | 68294 C | 8/1985 |
| GB | 1 564 643 | 4/1980 |

(Continued)

OTHER PUBLICATIONS

Notification of Reason for Refusal (with English translation) for Japanese Patent Application No. 2012-550484, dated Sep. 3, 2013.

(Continued)

*Primary Examiner* — Giovanna C Wright

(74) *Attorney, Agent, or Firm* — Morgan, Lewis & Bockius LLP

(57) ABSTRACT

A method for lubricating a drill shank of a rock drilling machine, wherein at least part of the flow of the pressure fluid of a hydraulic circuit of a device of the rock drilling machine performing at least one function is directed to the rotation mechanism of the drill shank for the purpose of lubricating the rotation mechanism of the drill shank.

24 Claims, 8 Drawing Sheets

(56) References Cited

U.S. PATENT DOCUMENTS

| | | | |
|---|---|---|---|
| 6,505,689 | B1 | 1/2003 | Pöysti et al. |
| 2007/0085339 | A1 | 4/2007 | Tsuji et al. |

FOREIGN PATENT DOCUMENTS

| | | | |
|---|---|---|---|
| GB | 2 122 271 | A | 1/1984 |
| JP | 58-211870 | | 12/1983 |
| JP | 10-47590 | | 2/1998 |
| JP | 2002-522672 | | 7/2002 |
| JP | 2007-51454 | | 3/2007 |
| JP | 2007-107312 | | 4/2007 |
| JP | 2008-267565 | | 11/2008 |
| WO | WO 00/08303 | | 2/2000 |

OTHER PUBLICATIONS

English translation of Notice of Grounds for Rejection for Korean Patent Application No. 2012-7022512, dated Nov. 5, 2013.

Official Action for Finnish Application No. 20105081, dated Oct. 22, 2012.

Search Report for Finnish Application No. 20105081, dated Oct. 21, 2012.

International Search Report for PCT/FI2011/050062, dated May 31, 2011.

Written Opinion for PCT/FI2011/050062, dated May 31, 2011.

* cited by examiner

METHOD AND ARRANGEMENT FOR LUBRICATING DRILL SHANK OF ROCK DRILLING MACHINE

RELATED APPLICATIONS

The present application is a U.S. National Phase Application of International Application No. PCT/FI2011/050062 (filed 27 Jan. 2011) which claims priority to Finnish Application No. 20105081 (filed 29 Jan. 2010).

BACKGROUND OF THE INVENTION

The invention relates to a method for lubricating the rotation mechanism of a drill shank in a rock drilling machine, the method comprising directing to the rotation mechanism of the drill shank at least part of the flow of the pressure fluid of a hydraulic circuit of a device of the rock drilling machine performing at least one function, for the purpose of lubricating the rotation mechanism of the drill shank.

The invention further relates to an arrangement for lubricating the rotation mechanism of the drill shank of a rock drilling machine, in which arrangement at least part of the flow of the pressure fluid of a hydraulic circuit of a device of the rock drilling machine performing at least one function is arranged to be directed to the rotation mechanism of the drill shank for the purpose of lubricating it.

Rock drilling rigs are used in rock drilling and excavating in underground mines, opencast mines and excavation sites. Known methods used in rock drilling and excavation are cutting, crushing and percussive methods. Percussive methods are most commonly used with hard rock. In the percussive method, the drilling tools, such as drill rods and the drill bit at the end thereof, of one or more rock drilling machines in a rock drilling rig are both rotated around their longitudinal axes and impact toward the rock being drilled. The breaking of the rock occurs mainly due to the impact. The purpose of the rotation is mainly to ensure that the studs or other working parts of the drill bit always impact a new point of rock. For striking, the rock drilling machine may comprise a hydraulic percussion device, the percussion piston of which causes stress pulses to the drill shank and further to the drilling tools of the rock drilling machine, which stress pulses travel in the form of a compression stress wave to the drilling tools at the extreme end of the drill bit and on to the rock, making the rock break. Instead of a hydraulic percussion device, the rock drilling machine may comprise a percussion device, in which means based on electromagnetism, for instance, cause a stress pulse to the drill shank without a mechanically moving percussion piston or other percussion member.

Typically, the lubrication of the rotation mechanism of the drill shank in a rock drilling machine, which can later also be called a drilling machine, is done with pressurized air, in which lubricating oil is added to compressed air. This lubricating air circulates inside the drilling machine, lubricates the necessary points, and is finally led out of the drilling machine. In some cases, the air may be circulated back to the rock drilling rig, and the lubricating oil is separated from the air and disposed of, or taken to be further processed for re-use. The lubricating oil that has circulated in the drilling machine is, thus, not returned to the drilling machine. In some solutions, the rotation mechanism of the drill shank may be lubricated by means of a separate circulation oil lubrication circuit, but the splines of the drill shank are still lubricated using pressurized air lubrication.

One problem with a pressurized air lubrication-based lubrication solution is that all lubricating oil cannot necessarily be recovered, but some of the lubricating oil remains in the air as micronic droplets. In addition, a pressurized air lubrication-based lubrication solution of a drill shank is not suitable for percussion devices where stress pulses are caused at a high frequency, for instance several hundreds or even thousands per second, in which case the pressurized air lubrication capacity is not enough to lubricate and cool the splines of the drill shank, for example, which leads to rapid wear of the splines of the drill shank and the rotation bushing or a corresponding member used in the rotation device.

BRIEF DESCRIPTION OF THE INVENTION

It is an object of the invention to provide a novel and improved method and arrangement for lubricating the rotation mechanism of a drill shank of a rock drilling machine.

The method of the invention is characterised by circulating the pressure fluid used in lubricating the rotation mechanism of the drill shank back to the hydraulic system of the rock drilling machine, to a hydraulic circuit of a device of the rock drilling machine performing at least one function.

The arrangement of the invention is characterised in that the pressure fluid used in lubricating the rotation mechanism of the drill shank is arranged to circulate back to the hydraulic system of the rock drilling machine, to a hydraulic circuit of a device of the rock drilling machine performing at least one function.

Thus, according to the solution, at least part of the flow of the pressure fluid of the hydraulic circuit of the device of the rock drilling machine performing at least one function is directed to the rotation mechanism of a drill shank for the purpose of lubricating it, and the pressure fluid used in lubricating the rotation mechanism of the drill shank is circulated back to the hydraulic system of the rock drilling machine, that is, to the hydraulic circuit of a device of the rock drilling machine performing at least one function.

The solution easily provides a sufficiently effective lubrication and cooling of the drill shank and its rotation mechanism. In addition, it is possible to leave out of the solution the compressed air source, such as compressor, necessary for pressurized air lubrication. Also, in the solution the same pressure fluid is used for lubrication as for performing the functions of the different devices of the rock drilling machine, so no separate lubricant and container for it are needed. By circulating the pressure fluid used in lubricating the rotation mechanism of the drill shank back to the hydraulic system of the rock drilling machine, it is possible to easily form a closed system for lubricating the drill shank and its rotation mechanism, in which case no lubricant escapes to the air, which is possible in conventional pressurized air lubrication.

According to an embodiment, at least part of the flow of the pressure fluid entering or exiting the percussion device of the rock drilling machine is directed to the rotation mechanism of the drill shank.

According to another embodiment, at least part of the flow of the pressure fluid entering or exiting the rotation device of the rock drilling machine is directed to the rotation mechanism of the drill shank.

According to a third embodiment, at least part of the flow of the pressure fluid entering or exiting the control unit used in controlling the position of the control valve of the percussion device of the rock drilling machine is directed to the rotation mechanism of the drill shank.

BRIEF DESCRIPTION OF THE FIGURES

Some embodiments of the invention will be described in more detail in the attached drawings, in which.

In the figures, some embodiments of the invention are shown simplified for the sake of clarity. Similar parts are marked with the same reference numbers in the figures.

DETAILED DESCRIPTION OF THE INVENTION

Figures 1, 2:
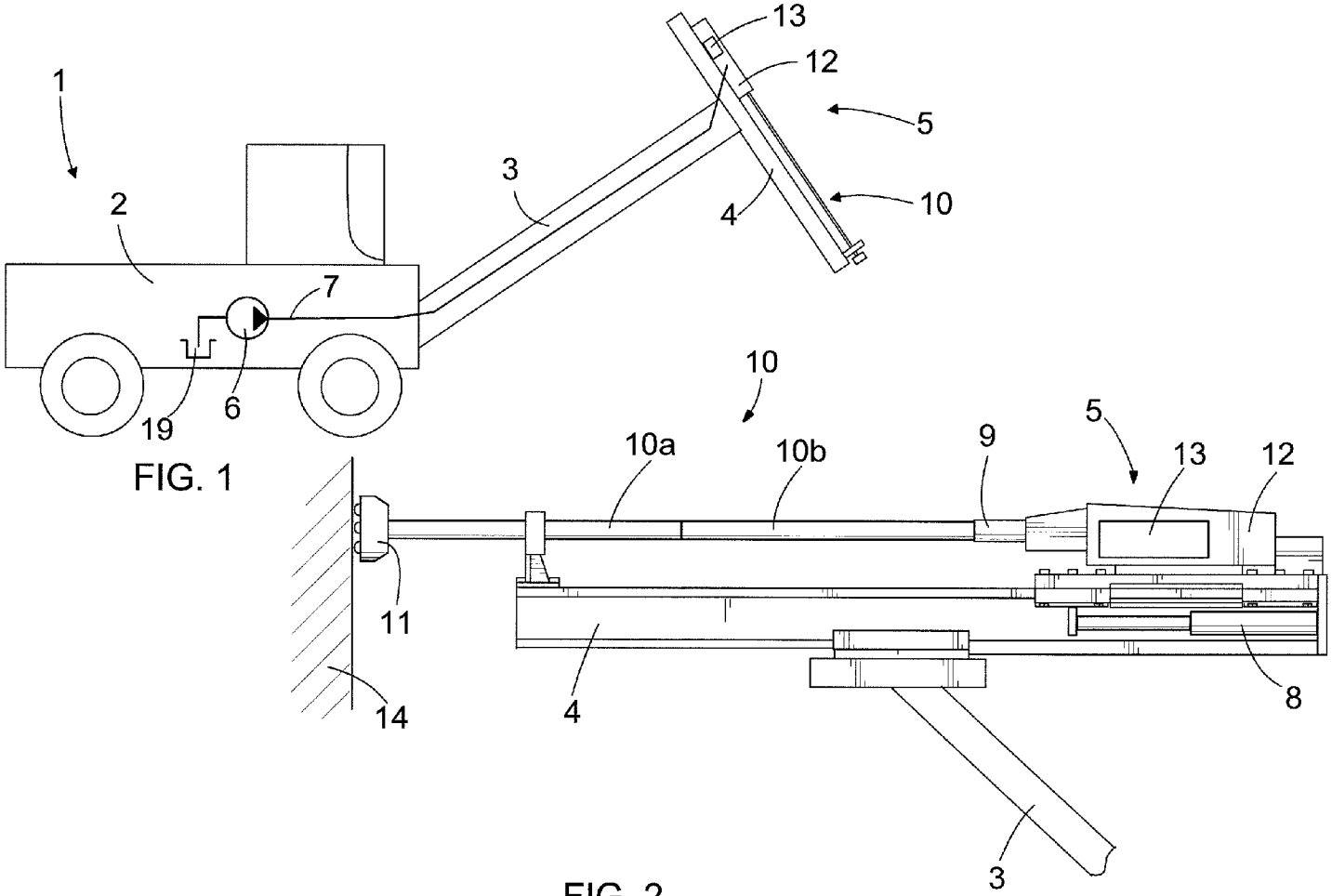
FIG. 1 is a schematic side view of a rock drilling rig.
FIG. 2 is a schematic side view of a rock drilling machine.

FIG. 1 is a schematic side view of a rock drilling rig 1 shown in a simplified manner. The rock drilling rig 1 of FIG. 1 comprises a carrier 2, one or more booms 3, and a feed beam 4 arranged to the free end of the boom 3. A rock drilling machine 5 or drilling machine 5 is further arranged to the feed beam 4. On the carrier 2 of the rock drilling rig 1, a pressure medium source, such as a hydraulic pump 6 or the like, may also be arranged, and by means of the pressure formed thereby, pressure fluid is directed along a pressure circuit 7 from a pressure medium container 19 serving as storage for the pressure fluid to the rock drilling machine 5 for performing various functions thereof.

FIG. 2 is a schematic side view of a rock drilling machine 5 that is arranged on the feed beam 4 movable with respect to the feed beam 4. The rock drilling machine 5 may be moved on the feed beam 4 by means of a feed device 8. The rock drilling machine 5 has a drill shank 9 to which the necessary drilling tools 10 may be connected, consisting of one or more drill rods 10*a*, 10*b* and a drill bit 11, for instance, the drilling tools 10 forming the tool 10 of the rock drilling machine 5. The rock drilling machine 5 further has a percussion device 12 for causing stress pulses to the drill shank 9. In addition, the rock drilling machine 5 has a rotation device 13, with which the drill shank 9 and the drilling tools 10 connected thereto may be rotated around their longitudinal axes. The drill shank 9 transmits impact, rotation and feed forces to the drilling tools 10 that transmit them on to the rock 14 being drilled.

Figure 3:
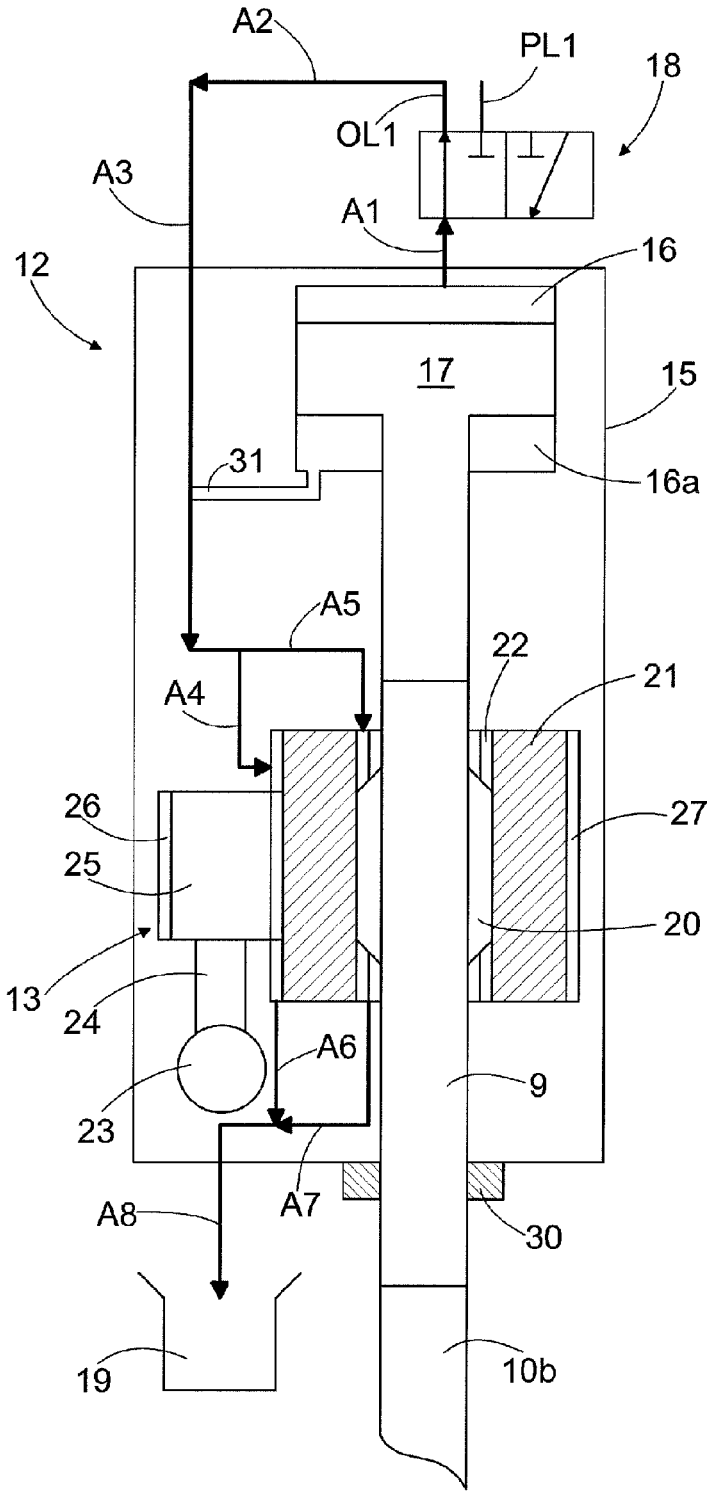
FIG. 3 is a schematic view of an arrangement for lubricating the rotation mechanism of a drill shank of a rock drilling machine.

FIG. 3 is a basic schematic cross-sectional side view of a percussion device 12, the frame 15 of which is in FIG. 3 only shown very schematically as a box marked by reference number 15 and also without cross-sectional lineation for the sake of clarity. Inside the frame 15, there is a work chamber 16 with a transmission piston 17. The transmission piston 17 is coaxial with the drill rod 10*b* or some other tool belonging to the drilling tools 10 of the rock drilling machine 5. Between the transmission piston 17 and drill rod 10*b*, there is a drill shank 9 that transmits a stress pulse generated by means of the transmission piston 17 to the drill rod 10*b*. The transmission piston 17 may move in its axial direction so that the transmission piston 17 touches the drill shank 9 at least when the stress pulse starts to form and during its formation. For forming the stress pulse, pressurized fluid is led to the work chamber 16 from a pressure medium source, such as pump 6 shown in FIG. 1, along a pressure line PL1 connected to the pressure circuit 7 through the control valve 18 of the percussion device 12, for example. The control valve 18 may be formed in many different ways obvious to a person skilled in the art, and the structure and operating principle of the control valve 18 is not described in this context in more detail. In FIG. 3, the control valve 18 is shown in the position in which it is during the return flow of the pressure fluid, that is, in a situation where the pressure fluid is allowed to flow away from the percussion device 12 through an outlet line OL1. A stress pulse is generated, when the pressure of the pressure fluid pushes the transmission piston 17 toward the drill shank 9 and, thus, presses the drill shank 9 and through the drill shank 9 the drill rods 10*a*, 10*b* and drill bit 11 against the rock 14 being drilled. In the percussion device 12 shown in FIG. 3, the stress pulse is formed without a specific percussion movement. When the control valve 18 closes the entry of the pressure fluid to the percussion device 12 and then allows the pressure fluid that has acted on the transmission piston 17 to exit along the output line OL1 to the pressure medium container 19, the stress pulse ends and the transmission piston 17 that has moved a short distance, in practice only a few millimeters, toward the drill shank 9 returns to its start position. This is repeated as the control valve 18 alternately switches the pressure to act on the transmission piston 17 and then allows the pressure to discharge from the percussion device 12, whereby, controlled by the control valve 18, a series of consecutive stress pulses is formed. To return the transmission piston 17, it is, when necessary, possible to supply pressure medium into the chamber 16*a* between stress pulses or the transmission piston 17 can be returned by mechanical means, such as a spring, or by pushing the percussion device 12 with the feed device 8 in the drilling direction, whereby the transmission piston 17 moves backward relative to the percussion device 12 to its start position.

During the operation of the percussion device 12, the percussion device 12 is pushed by means of the feed device 8 in a manner known per se toward the drill rods 10*a*, 10*b* and, at the same time, the material being drilled.

The drill shank 9 has splines 20 that connect to grooves 22 on the inner circumference of the rotation bushing 21 surrounding the drill shank 9, whereby the drill shank 9 can be rotated via the rotation bushing 21. The rotation bushing 21 is, in turn, rotated by a rotating motor 23 with a gear ring 25 that is connected to the axle 24 of the motor 23 and has on its surface grooves 26 that connect to grooves 27 on the outer circumference of the rotation bushing 21. The rotating motor 23, axle 24, gear ring 25, and rotation bushing 21 form a rotation device 13, through which the drill shank 9 and drilling tools 10 connected thereto can be rotated during drilling. In the embodiment of FIG. 1, the gear ring 25, rotation bushing 21, and splines 20 of the drill shank 9 form the rotation mechanism of the drill shank 9, but the rotation mechanism of the drill shank 9 can be formed in many different ways and in this specification, the rotation mechanism of the drill shank 9 refers to the means or parts, through which the rotation movement produced by the rotating motor 23 is transmitted to the drill shank 9. Further, the basic structure and operation of the rotation equipment is known per se to a person skilled in the art, and they are not described in more detail herein.

The lubrication of the rotation mechanism of the drill shank 9, that is, in the embodiment of FIG. 3, the lubrication between the splines 20 of the drill shank 9 and the grooves 22 on the inner circumference of the rotation bushing 21 and the lubrication between the gear ring 25 and the grooves 27 on the outer circumference of the rotation bushing 21 are arranged by means of the return flow of the hydraulic circuit or percussion circuit of the percussion device 12. In FIG. 3, the return flow of the hydraulic circuit is shown by arrows drawn in bold type, and the direction shown by the arrow shows schematically the travel of the return flow of the percussion device 12 hydraulic circuit. The flow of the pressure fluid returning from the work chamber 16 of the percussion device 12, which in FIG. 3 is shown by arrow A1, is directed by the control valve 18 to the output line OL1, from which the pressure fluid is arranged to flow, as shown schematically by arrows A2 and A3, toward the drill shank 9, where the flow is divided into two sub-flows A4 and A5, and sub-flow A4 is directed to lubricate the connection between the gear ring 25 and the grooves 27 on the outer circumference of the rotation bushing 21, and sub-flow A5 is directed to lubricate the connection between the splines 20 of the drill shank 9 and the grooves 22 on the inner circumference of the rotation bushing 21. The flow exiting from the gap between the gear ring 25 and the grooves 27 on the outer circumference of the rotation bushing 21 is shown by arrow A6, and the flow exiting from the gap between the splines 20 of the drill shank 9 and the grooves 22 on the inner circumference of the rotation bushing 21 is shown by arrow A7. In the embodiment shown in FIG. 3, the sub-flows A6 and A7 are then combined into one flow A8 before directing it to the pressure medium container 19, even though the sub-flows A6 and A7 could naturally also be directed to the pressure medium container 19 as separate flows.

FIG. 1 only shows one pressure medium container 19 that is located in connection with the carrier 2 of the rock drilling rig 1. However, the rock drilling rig 1 can comprise several pressure medium containers in such a manner, for instance, that in addition to the pressure medium container located in connection with the carrier 2 of the rock drilling rig 1, each rock drilling machine 5 arranged to the rock drilling rig has its own pressure medium container.

There may also be more than one pressure medium sources, such as hydraulic pumps 6, in such a manner, for instance, that the rotation device 13 has its own pressure medium source and the feed device 8 and percussion device 12 have their own common pressure medium source. There may also be a separate pressure medium source for operating the boom 3.

In the solution of FIG. 3, the return flow of the pressure fluid of the hydraulic circuit of the percussion device 12, that is, the pressure fluid flow exiting the percussion device 12, is thus used to lubricate the rotation mechanism of the drill shank, while the percussion device 12 forms a device of the rock drilling machine that implements at least one function. The solution easily provides sufficiently effective lubrication and cooling of the drill shank and its rotation mechanism. The solution also does not require the compressed air source, such as compressor, necessary for pressurized air lubrication, nor is a separate lubricant required, which is not necessarily even re-circulatable. When the pressure fluid used in lubricating the rotation mechanism of the drill shank 9 is led to the pressure medium container 19, the lubrication of the rotation mechanism of the drill shank 9 forms a closed system, in which case no micronic lubricant can enter the surrounding air, as may happen in conventional pressurized air lubrication, and the pressure fluid used in lubrication can be circulated back to the hydraulic system of the rock drilling machine 5, to the hydraulic circuit of the percussion device 12, for example. The transmission piston 17 also does not require a separate sealing, because a possible leak from the work chamber 16 past the transmission piston 17 flows to the drill shank 9 and then back to the oil circulation. However, it is advantageous to place a sealing outside the percussion device 12 to prevent an oil leak from the percussion device 12 around the drill shank 9. This sealing is shown very schematically and marked by reference number 30 in FIG. 3.

Also, in the solution of FIG. 3, the need for feed force decreases substantially if the return of the transmission piston 17 is done by feed force directed to the percussion device 12 and not with a separate return work surface area or mechanical auxiliary device, for example. As the pressure of the pressure medium container acts on both sides of the transmission piston 17, most of the force caused by the pressure of the pressure medium container is cancelled out, and thus the need for feed force decreases. The chamber **16*a* may be connected to the pressure of the pressure medium container through a connecting channel 31 arranged between the chamber 16*a* and the flow channel marked by arrow A3**.

In the embodiment shown in FIG. 3, the entire return flow from the work chamber 16 of the percussion device 12 is directed for use in lubricating the rotation mechanism of the drill shank, but it is clear that it is also possible to have an embodiment, where only part of the return flow of the percussion circuit of the percussion device 12 is directed for use in lubricating the rotation mechanism of the drill shank, while the rest of the return flow goes directly back to the pressure medium container 19.

In the embodiment shown in FIG. 3, as in the embodiments shown in the following figures, the return flow of the pressure fluid is shown very schematically by arrows drawn in bold type, but it is clear that in practice the pressure fluid is, outside the percussion device 12, arranged to flow along appropriate pressure hoses or the like and, in the percussion device, through flow channels made by drilling, for instance, to the frame of the percussion device.

Figure 4:
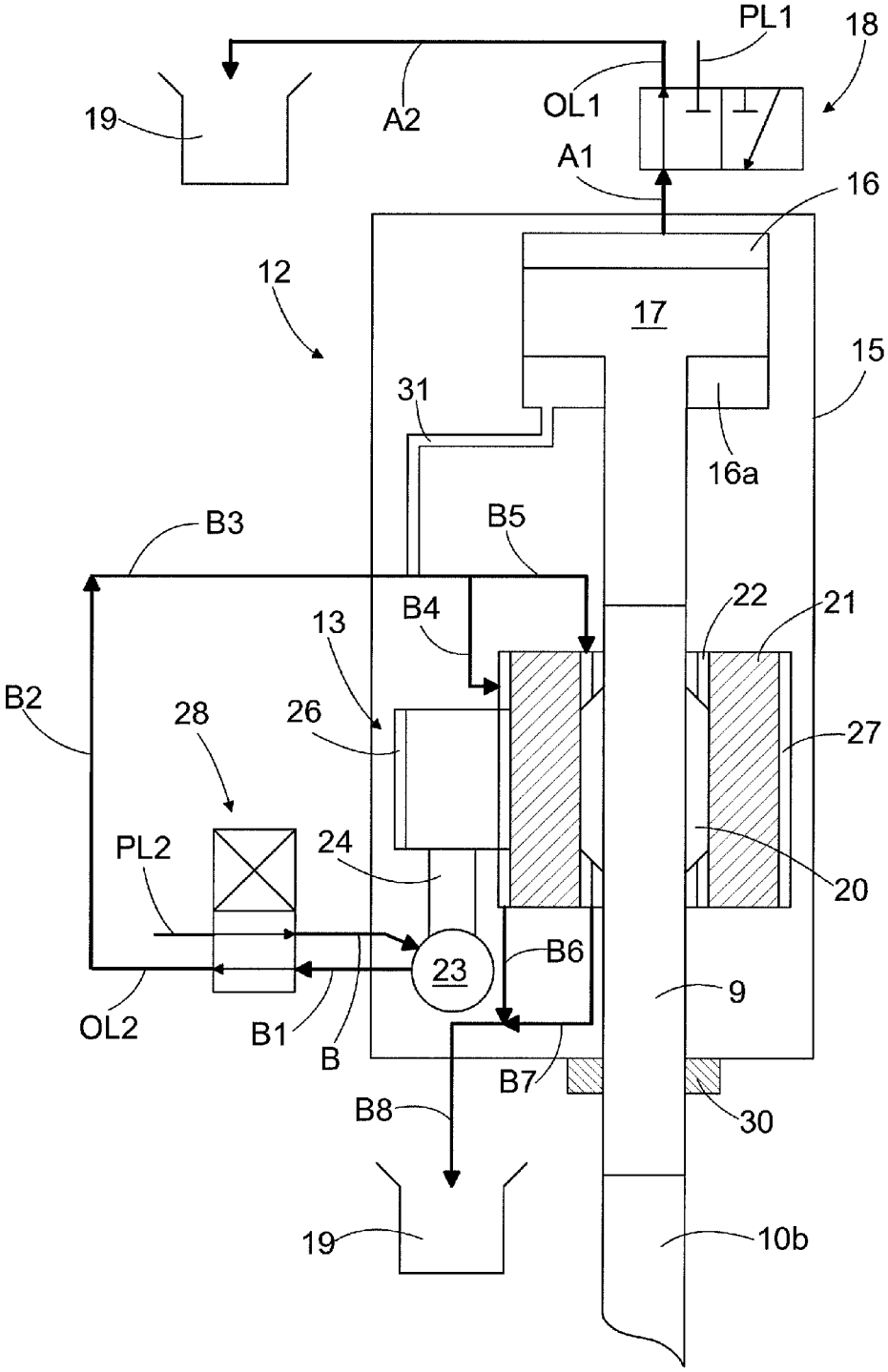
FIG. 4 is a schematic view of another arrangement for lubricating the rotation mechanism of a drill shank of a rock drilling machine.

FIG. 4 is a schematic cross-sectional side view of the percussion device 12 of FIG. 3, the operation of which is thus similar to that shown in FIG. 3 with the exception, however, that the exiting pressure fluid flow from the percussion device 12, which is marked by arrow A1, is directed directly to the pressure medium container 19 in the manner shown by arrow A2.

FIG. 4 further shows the control valve 28 of the rotation device 13 used to control the operation of the rotating motor 23. For driving the rotating motor 23, pressurized fluid is led to the rotating motor 23 from a pressure source, such as the pump 6 shown in FIG. 1, along a pressure line PL2 through the control valve 28 in the manner shown schematically by arrow B. The control valve 28 may be formed in many different ways obvious to a person skilled in the art, and the structure and operating principle of the control valve 28 is not described in this context in more detail. The return flow of the pressure fluid from the rotating motor 23 goes through an output line OL2. The supply flow or incoming flow of the pressure fluid to the rotating motor 23 and the return flow or exiting flow from the rotating motor 23 are typically continuous during the operation of the rotating device 23.

The lubrication of the rotation mechanism of the drill shank 9, that is, the lubrication between the splines 20 of the drill shank 9 and the grooves 22 on the inner circumference of the rotation bushing 21 and the lubrication between the gear ring 25 and the grooves 27 on the outer circumference of the rotation bushing 21, is in the embodiment of FIG. 4 arranged by means of the return flow of the hydraulic circuit, or rotation circuit, of the rotating device 13, the rotating device 13 thus forming a device of the rock drilling machine performing at least one function. In FIG. 4, the return flow of the hydraulic circuit of the rotating device is shown by arrows drawn in bold type, and the direction shown by the arrow shows schematically the travel of the return flow of the rotating device 13 hydraulic circuit. The flow of the pressure fluid exiting the rotating device 13 and especially the rotating motor 23, which in FIG. 4 is shown by arrow B1, is directed by a control valve 28 to the output line OL2, from which the pressure fluid is arranged to flow, as shown schematically by arrows B2 and B3, toward the drill shank 9, where the flow is divided into two sub-flows B4 and B5, and sub-flow B4 is directed to lubricate the connection between the gear ring 25 and the grooves 27 on the outer circumference of the rotation bushing 21, and sub-flow B5 is directed to lubricate the connection between the splines 20 of the drill shank 9 and the grooves 22 on the inner circumference of the rotation bushing 21. The flow exiting from the gap between the gear ring 25 and the grooves 27 on the outer circumference of the rotation bushing 21 is shown by arrow B6, and the flow exiting from the gap between the splines 20 of the drill shank 9 and the grooves 22 on the inner circumference of the rotation bushing 21 is shown by arrow B7. In the embodiment shown in FIG. 4, the sub-flows B6 and B7 are then combined into one flow B8 before directing it to the pressure medium container 19, even though the sub-flows B6 and B7 could naturally also be directed to the pressure medium container 19 as separate flows.

In the solution of FIG. 4, the return flow of the pressure fluid in the hydraulic circuit of the rotating device 13 is thus used to lubricate the rotation mechanism of the drill shank. The advantages of the solution are the same as those presented earlier in connection with the embodiment of FIG. 3. If the transmission piston 17 is to be returned to its start position merely by using the feed force of the feed device 8, the required feed force can be decreased by connecting the chamber 16*a* to the pressure of the pressure medium container through a connecting channel 31 arranged between the chamber 16*a* and the flow channel marked by arrow B3.

In the embodiment shown in FIG. 4, the entire flow of the pressure fluid exiting the rotating device 13 is directed for use in lubricating the rotation mechanism of the drill shank, but it is clear that it is also possible to have an embodiment, where only part of the return flow of the hydraulic circuit of the rotating device 13 is directed for use in lubricating the rotation mechanism of the drill shank, while the rest of the return flow goes back to the pressure medium container 19.

Figure 5:
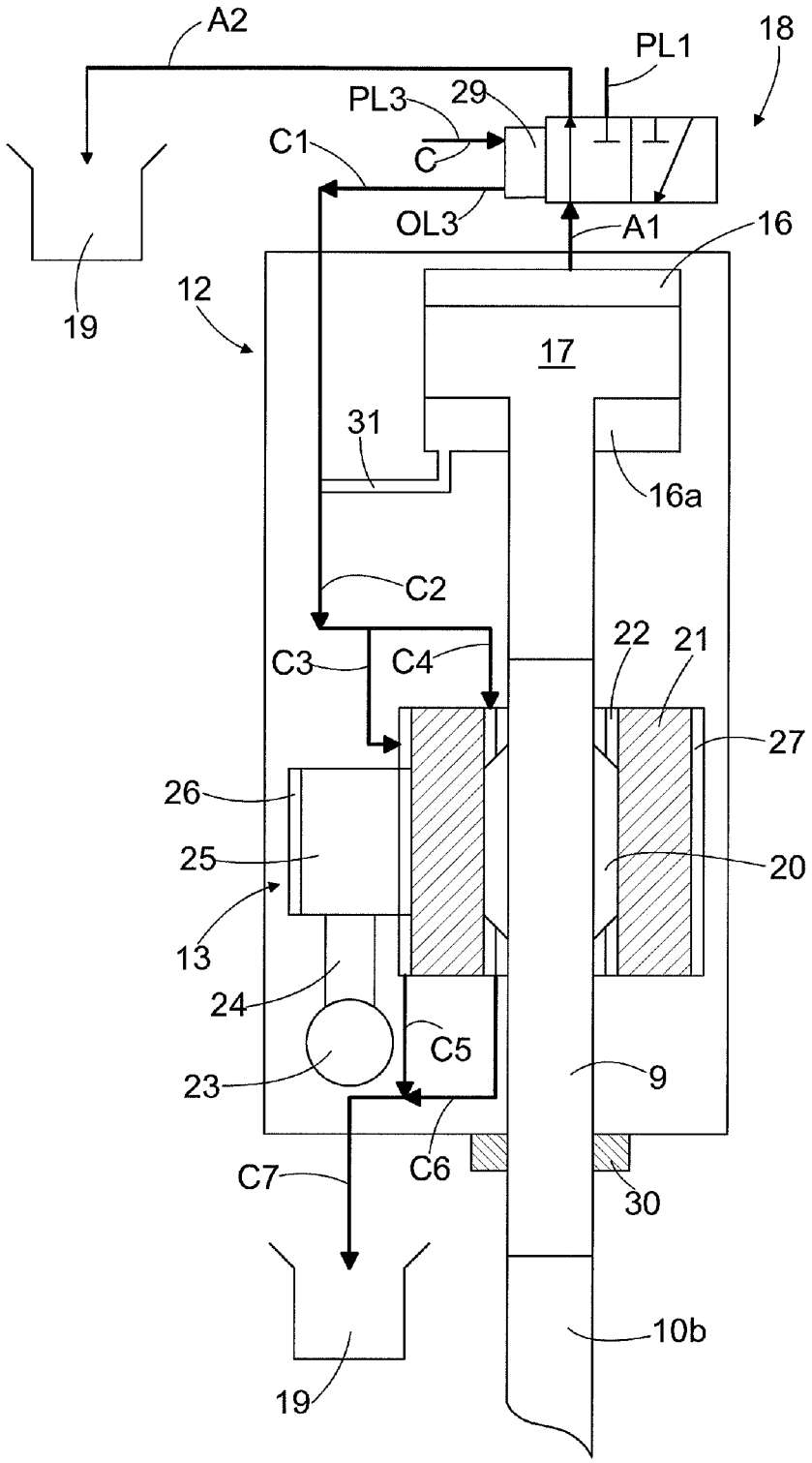
FIG. 5 is a schematic view of a third arrangement for lubricating the rotation mechanism of a drill shank of a rock drilling machine.

FIG. 5 is a schematic cross-sectional side view of the percussion device 12 of FIG. 3, the operation of which is thus similar to that shown in FIG. 3 with the exception, however, that the exiting pressure fluid flow from the percussion device 12, which is marked by arrow A1, is directed directly to the pressure medium container 19 in the manner shown by arrow A2.

FIG. 5 further shows very schematically a control unit 29 used for controlling the operation of the control valve 18 of the percussion device 12, that is, in practice for adjusting the position of the control valve 18, and operating under the effect of pressure fluid, and a pressure line PL3 conducting pressurized fluid from a pressure source, such as the pump 6 shown in FIG. 1, to the control unit 29 as shown schematically by arrow C. The return flow of the pressure fluid from the control unit 29 goes through an output line OL3. The control unit 29 can be formed in many different ways that are obvious to a person skilled in the art, and the structure and operation of the control device 29 is not described herein in more detail.

The lubrication of the rotation mechanism of the drill shank 9, that is, the lubrication between the splines 20 of the drill shank 9 and the grooves 22 on the inner circumference of the rotation bushing 21 and the lubrication between the gear ring 25 and the grooves 27 on the outer circumference of the rotation bushing 21 are in the embodiment shown in FIG. 5 arranged by means of the return flow of the hydraulic circuit or operating circuit of the control unit 29 of the control valve 18 of the percussion device 12. In FIG. 5, the return flow of said hydraulic circuit is shown by arrows drawn in bold type, and the direction shown by the arrow shows schematically the travel of the return flow of the control unit 29 hydraulic circuit. The flow of the pressure fluid exiting the control unit 29 is arranged to flow, as shown schematically by arrows C1 and C2, toward the drill shank 9, where the flow is divided into two sub-flows C3 and C4, and sub-flow C3 is directed to lubricate the connection between the gear ring 25 and the grooves 27 on the outer circumference of the rotation bushing 21, and sub-flow C4 is directed to lubricate the connection between the splines 20 of the drill shank 9 and the grooves 22 on the inner circumference of the rotation bushing 21. The flow exiting from the gap between the gear ring 25 and the grooves 27 on the outer circumference of the rotation bushing 21 is shown by arrow C5, and the flow exiting from the gap between the splines 20 of the drill shank 9 and the grooves 22 on the inner circumference of the rotation bushing 21 is shown by arrow C6. In the embodiment shown in FIG. 5, the sub-flows C5 and C6 are then combined into one flow C7 before directing it to the pressure medium container 19, even though the sub-flows C5 and C6 could naturally also be directed to the pressure medium container 19 as separate flows.

In the solution of FIG. 5, the return flow of the pressure fluid of the hydraulic circuit of the control unit 29 controlling the operation of the control valve 18 of the percussion device 12 is thus used to lubricate the rotation mechanism of the drill shank, while the control unit 29 forms a device of the rock drilling machine that implements at least one function. The advantages of the solution are the same as those presented earlier in connection with the embodiment of FIG. 3. If the transmission piston 17 is to be returned to its start position merely by using the feed force of the feed device 8, the required feed force can be decreased by connecting the chamber 16*a* to the pressure of the pressure medium container through the connecting channel 31 arranged between the chamber 16*a* and the flow channel marked by arrow C2.

In the embodiment shown in FIG. 5, the entire flow of the pressure fluid exiting the control unit 29 is directed for use in lubricating the rotation mechanism of the drill shank, but it is clear that it is also possible to have an embodiment, where only part of the return flow of the control device 29 is directed for use in lubricating the rotation mechanism of the drill shank, while the rest of the return flow goes back to the pressure medium container 19.

Figure 6:
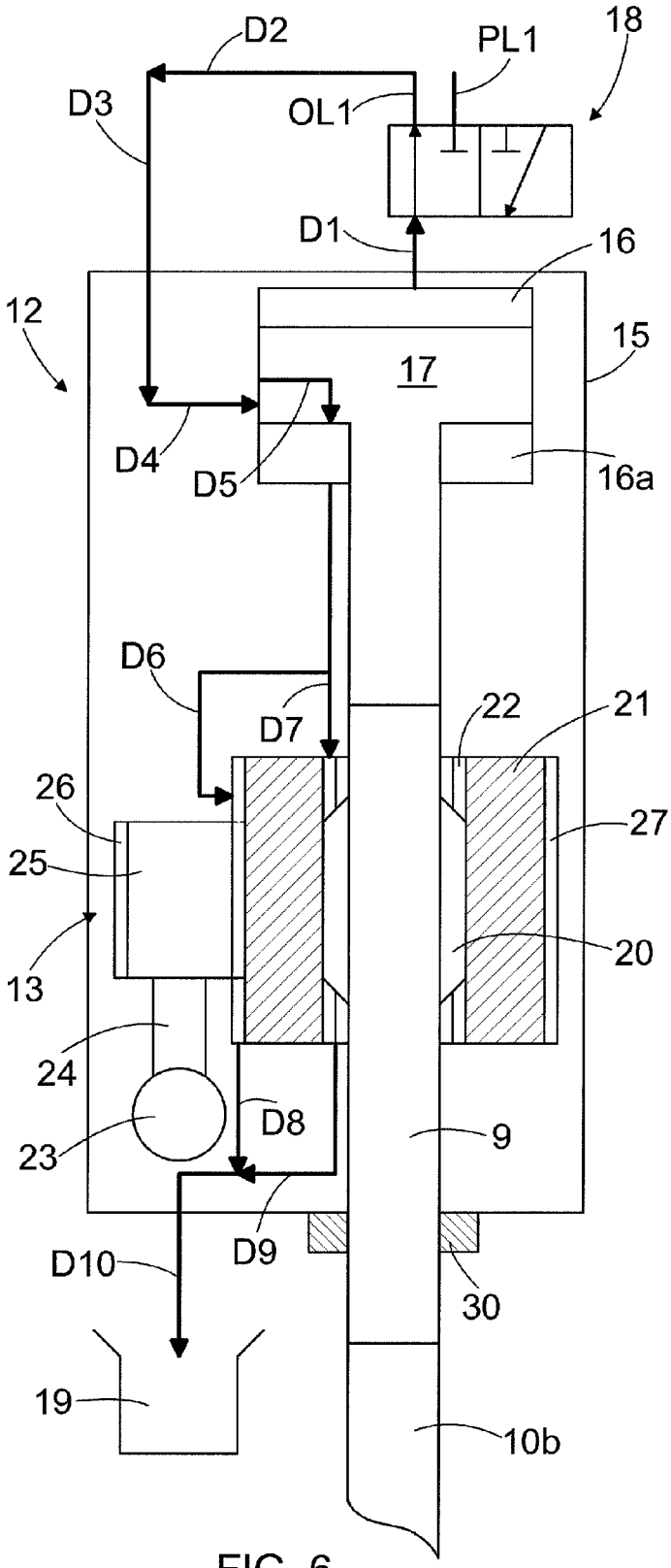
FIG. 6 is a schematic view of a fourth arrangement for lubricating the rotation mechanism of a drill shank of a rock drilling machine.

FIG. 6 is a schematic cross-sectional general side view of a second percussion device 12. The percussion device 12 of FIG. 6 resembles in structure that shown in FIGS. 3 to 5 with the exception, however, that in FIG. 6, the transmission piston 17 of the percussion device 12 has a flow channel shown by arrow D5, through which, during the return movement of the transmission piston 17, pressure fluid can flow through the transmission piston 17 and chamber 16*a* toward the drill shank for the purpose of lubricating the rotation mechanism of the drill shank 9. During the return movement of the transmission piston 17, pressure fluid returns from the work chamber 16 as return flow D1 that is directed toward the drill shank 9 in the manner shown by arrows D2, D3, and D4. In FIG. 6, the control valve 18 is thus shown in a position where it is during the return flow of the pressure fluid prior to the generation of a stress pulse, when the pressure fluid is allowed to flow away from the percussion device 12 through the output line OL1. During the generation of the stress pulse preceding the return flow, the transmission piston 17 is allowed to move toward the drill shank 9 to the extent that the flow channel marked by arrow D4 and the flow channel marked by arrow D5 move into alignment. From the flow channel marked by arrow D5, the pressure fluid is allowed to flow through the chamber 16*a* on toward the drill shank 9, and the flow of the pressure fluid is divided into two sub-flows D6 and D7, and sub-flow D6 is directed to lubricate the connection between the gear ring 25 and the grooves 27 on the outer circumference of the rotation bushing 21, and sub-flow D7 is directed to lubricate the connection between the splines 20 of the drill shank 9 and the grooves 22 on the inner circumference of the rotation bushing 21. The flow exiting from the gap between the gear ring 25 and the grooves 27 on the outer circumference of the rotation bushing 21 is marked by arrow D8, and the flow exiting from the gap between the splines 20 of the drill shank 9 and the grooves 22 on the inner circumference of the rotation bushing 21 is marked by arrow D9. In the embodiment shown in FIG. 6, the sub-flows D8 and D9 are then combined into one flow D10 before directing it to the pressure medium container 19, even though the sub-flows D8 and D9 could naturally also be directed to the pressure medium container 19 as separate flows.

In the embodiment shown in FIG. 6, the entire return flow from the work chamber 16 of the percussion device 12 is directed for use in lubricating the rotation mechanism of the drill shank, but it is clear that it is also possible to have an embodiment, where only part of the return flow of the work chamber 16 of the percussion device 12 is directed for use in lubricating the rotation mechanism of the drill shank, while the rest of the return flow goes directly back to the pressure medium container 19.

In the embodiment of FIG. 6, the connection of the flow channels marked by arrows D4 and D5 is thus formed during the generation of the impact pulse or stress pulse, when the transmission piston 17 moves toward the drill shank 9. As the return movement of the transmission piston 17 begins and for a time during the return movement of the transmission piston, the flow channels marked by arrows D4 and D5 are in connection with each other, whereby the pressure fluid returning from the work chamber 16 is allowed to flow through the flow channels marked by arrows D4 and D5 to the chamber 16*a* and from there on toward the drill shank 9 and its rotation mechanism. During the final stage of the return movement, the connection between the flow channels marked by arrows D4 and D5 closes, when the transmission piston 17 moves to its start position shown in FIG. 6, where it is before the stress pulse is generated. The duration of the connection between the flow channels marked by arrows D4 and D5 can be influenced by the dimensioning of the diameters of said flow channels, for instance.

Figure 7:
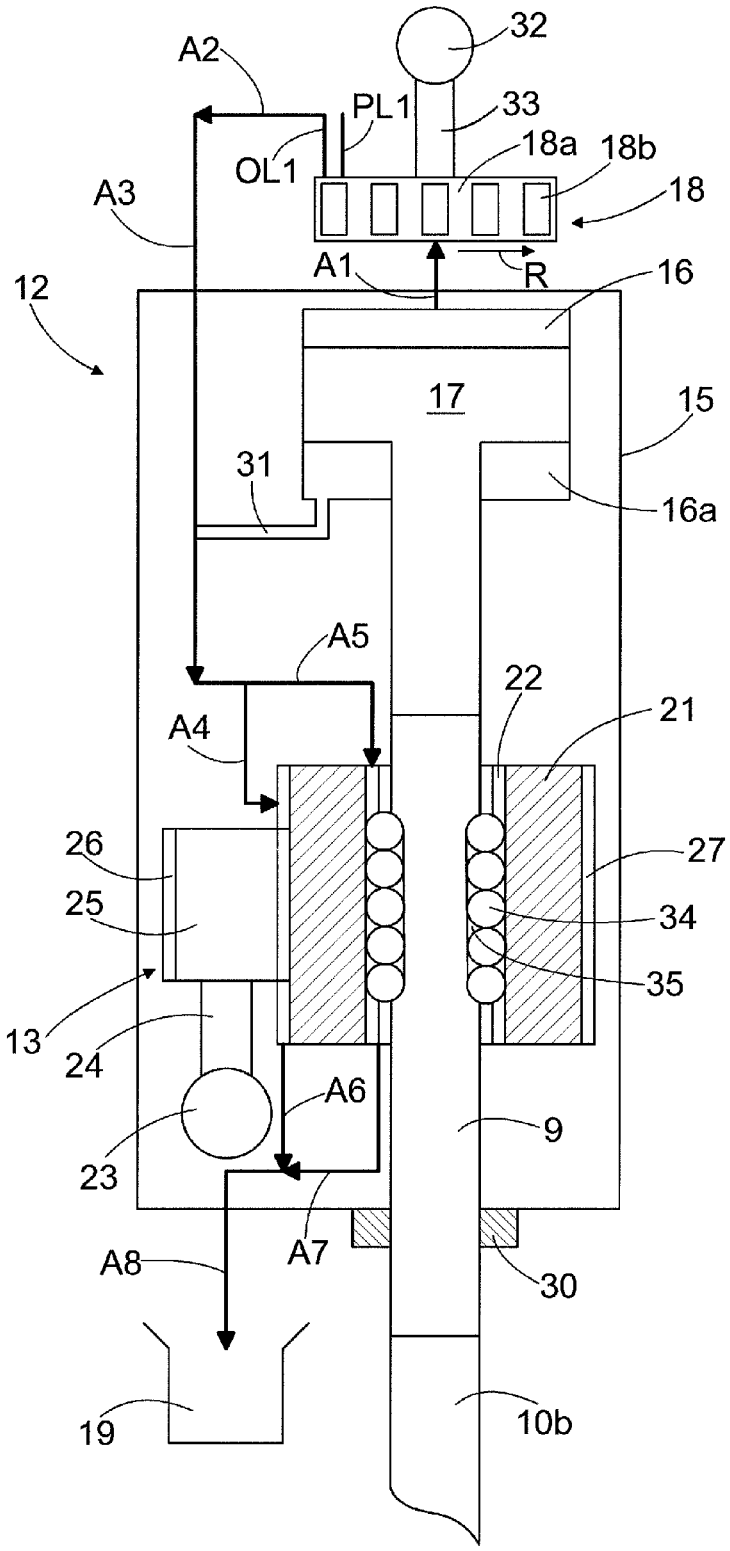
FIG. 7 is a schematic view of a fifth arrangement for lubricating the rotation mechanism of a drill shank of a rock drilling machine.

FIG. 7 is a schematic view of a fifth arrangement for lubricating the rotation mechanism of a drill shank of a rock drilling machine. The arrangement of FIG. 7 corresponds to that of FIG. 3 with the exception, however, that in the arrangement of FIG. 8 the control valve 18 of the percussion device 12 comprises a rotatable switch member 18*a* that can be rotated by means of the motor 32 and axle 33 or some other suitable mechanism in the direction shown by arrow R or rotatably back and forth. The switch member 18*a* has one or, as shown in FIG. 7, several channels, such as openings 18*b* or grooves 18*b*, and when the switch member 18*a* moves, pressure fluid is allowed to act from the pressure line PL1 to the transmission piston 17 and, correspondingly, as the switch member 18*a* moves on, the pressure fluid that acted on the transmission piston 17 is allowed to exit through the output line OL1. In FIG. 7, the control valve 18 is shown in the position, in which the pressure fluid is allowed to flow away from the percussion device 12 through the outlet line OL1. The motor 32 rotating the switch member 18*a* of the control valve 18, the control valve 18 equipped with the rotatable switch member 18*a*, and the transmission piston 17 can be positioned in many ways relative to each other, but preferably the motor 32, valve 18, and transmission piston 17 are positioned coaxially to each other in the manner shown schematically in FIG. 7.

The arrangement of FIG. 7 also differs from that of FIG. 3 in how the power used in rotating the drill shank 9 is transmitted from the rotation bushing 21 to the drill shank 9. In the arrangement of FIG. 3, the drill shank 9 has splines 20 to transmit the power required to rotate the drill shank from the rotation bushing 21 to the drill shank 9, but in the arrangement of FIG. 7, balls 34 are arranged between the rotation bushing 21 and drill shank 9, and the balls are positioned on one hand in the grooves 22 of the rotation bushing 21 and on the other hand in grooves 35 formed in the drill shank 9 so that the balls 34 and the edges of the grooves 22 and 35 supporting them transmit the power required to rotate the drill shank 9 from the rotation bushing 21 to the drill shank 9. In the embodiment of FIG. 7, the rotation mechanism of the drill shank 9 thus comprises the gear ring 25, rotation bushing 21, and balls 34. Instead of round balls 34, it is also possible to use cylindrical rolls or ones with curved surfaces, for instance, and grooves 22 and 35 shaped correspondingly.

In spite of the above differences between the arrangement of FIG. 3 and that of FIG. 7, the lubrication of the rotation mechanism of the drill shank 9 operates by the same principle in FIG. 7 as already described in connection with FIG. 3.

Figure 8:
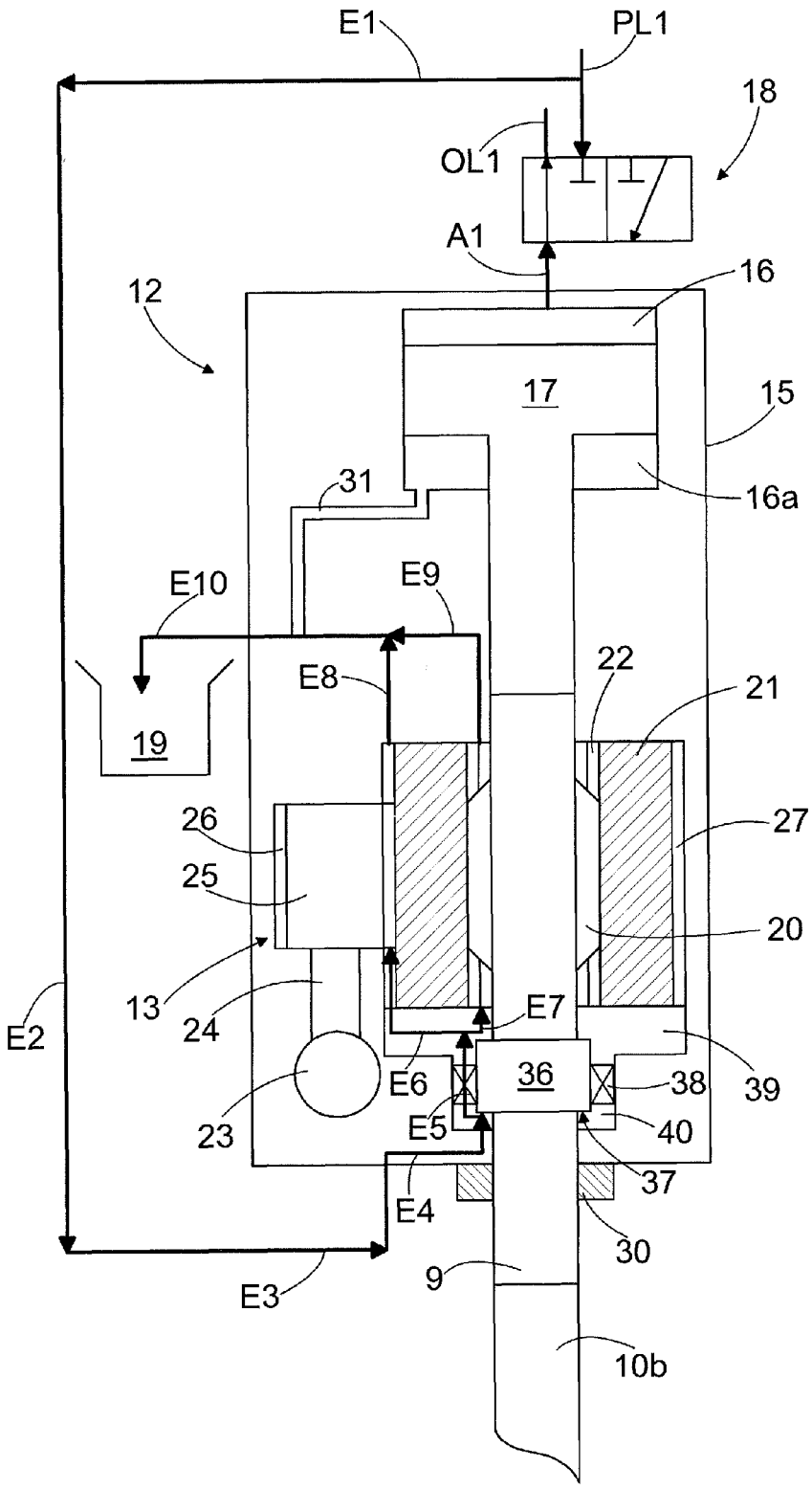
FIG. 8 is a schematic view of a sixth arrangement for lubricating the rotation mechanism of a drill shank of a rock drilling machine.

FIG. 8 is a schematic cross-sectional side view of a percussion device 12 that mainly corresponds to that shown in FIG. 3 but differs from the percussion device of FIG. 3 in that the drill shank 9 of the percussion device 12 of FIG. 8 has a flange 36, which flange 36 is arranged at least partly or entirely inside a chamber 40 in the frame structure 15 of the percussion device 12 and which flange 36 forms a work surface area 37 or surface area 37, to which surface area 37 a pressure can be made to act so as to influence the position of the drill shank 9 and transmission piston 17 in the percussion device. The drill shank 9 is supported to the frame 15 of the percussion device 12 through bearings 38. Behind the flange 36 and bearings 38, there is further a chamber 39, by means of which the lubrication of the drill shank 9 and its rotation mechanism can be arranged.

The lubrication of the rotation mechanism of the drill shank 9, that is, the lubrication between the splines 20 of the drill shank 9 and the grooves 22 on the inner circumference of the rotation bushing 21 and the lubrication between the gear ring 25 and the grooves 27 on the outer circumference of the rotation bushing 21 are in the embodiment shown in FIG. 8 arranged by means of the pressure fluid entering the percussion device 12. In the embodiment of FIG. 8, part of the pressure fluid entering the percussion device 12 from the pressure medium source along the pressure line PL1 of the percussion device 12 is led to act on the work surface area 37 of the flange 36 arranged on the drill shank 9. This flow is marked by arrows drawn in bold type, and the direction shown by the arrow shows schematically the travel of the flow. Part of the pressurized fluid entering the percussion device 12 along the pressure line PL1 is led through a valve not shown in FIG. 8 in the manner shown schematically by arrows E1, E2, E3, and E4 toward the drill shank 9. In the drill shank 9, the pressurized fluid is arranged to act on the work surface area 37 on the flange 36 in the manner shown schematically by arrow E4. The pressure acting on the work surface area 37 pushes both the drill shank 9 and transmission piston 17 backward, thus returning the drill shank 9 and transmission piston 17 toward their original position before the next stress pulse caused by the percussion device. At the same time, the attachment of the drill shank 9 and transmission piston 17 to each other is also enhanced, that is, this solution can be used to adjust the position of the drill shank 9 in the percussion device 12. In the embodiment shown in FIG. 8, said work surface area is thus arranged to the drill shank 9 and not the transmission piston 17 or percussion piston of a hydraulic percussion device, as is usual.

At least part of the flow acting on the work surface area 37 and marked by arrow E4 is still allowed to flow past the flange 36 in the drill shank 9 in the manner shown by arrow E5 either as a leakage flow through the bearings 38 or along one or more pressure-lowering throttle channels arranged in the flange 36 or separately beside the flange 36 to a chamber 39 behind the flange 36. In the chamber 39, the flow divides into two sub-flows E6 and E7, and the sub-flow E6 lubricates the connection between the gear ring 25 and the grooves 27 on the outer circumference of the rotation bushing 21, and the sub-flow E7 lubricates the connection between the splines 20 of the drill shank 9 and the grooves 22 on the inner circumference of the rotation bushing 21. The flow exiting from the gap between the gear ring 25 and the grooves 27 on the outer circumference of the rotation bushing 21 is shown by arrow E8, and the flow exiting from the gap between the splines 20 of the drill shank 9 and the grooves 22 on the inner circumference of the rotation bushing 21 is shown by arrow E9. In the embodiment shown in FIG. 8, the sub-flows E8 and E9 are then combined into one flow E10 before directing it to the pressure medium container 19, even though the sub-flows E8 and E9 could naturally also be directed to the pressure medium container 19 as separate flows.

In the embodiment of FIG. 8, the flange 36 and chamber 40 form a cylinder actuator affecting the operation of the rock drilling machine 5 and influencing the position of the drill shank 9 and/or transmission piston 17 in the percussion device 12. The pressure fluid flowing into the chamber 39 behind the flange 36 as a leakage flow either through the flange 36 and/or past it along separate pressure-lowering throttle channels and/or as leakage flow through bearing clearances of the bearings 38 is the return flow of the pressure fluid of said actuator, that is, flow exiting the actuator, which is further used in the manner described above to lubricate the rotation mechanism of the drill shank 9. The quantity of the leakage flow flowing through the bearing clearances of the bearings 38 to the chamber 39 can be influenced by the degree or efficiency of the sealing between the flange 36 and the frame 15 of the percussion device 12, said leakage flow thus also being part of the functionality designed for the flange 36 and its work surface area 37.

In the solution of FIG. 8, part of the flow of the hydraulic circuit of the percussion device 12 is thus used to return the drill shank 9 and transmission piston 17 toward their original positions. The return flow of the pressure fluid created as a result of this function is, in turn, used in lubricating the rotation mechanism of the drill shank. Instead of using the operating pressure of the percussion device 12, the operating pressure required for providing the return function of the drill shank 9 and transmission piston could be derived from the operating pressure of the rotating device 13, that is, from the pressure line PL2 of the rotating device 13, from the operating pressure of the control unit 29 controlling the operation of the control valve 18, that is, from the pressure line PL3 of the control unit 29, or from adjustable operating pressure of a circuit separate from these.

Figure 9:
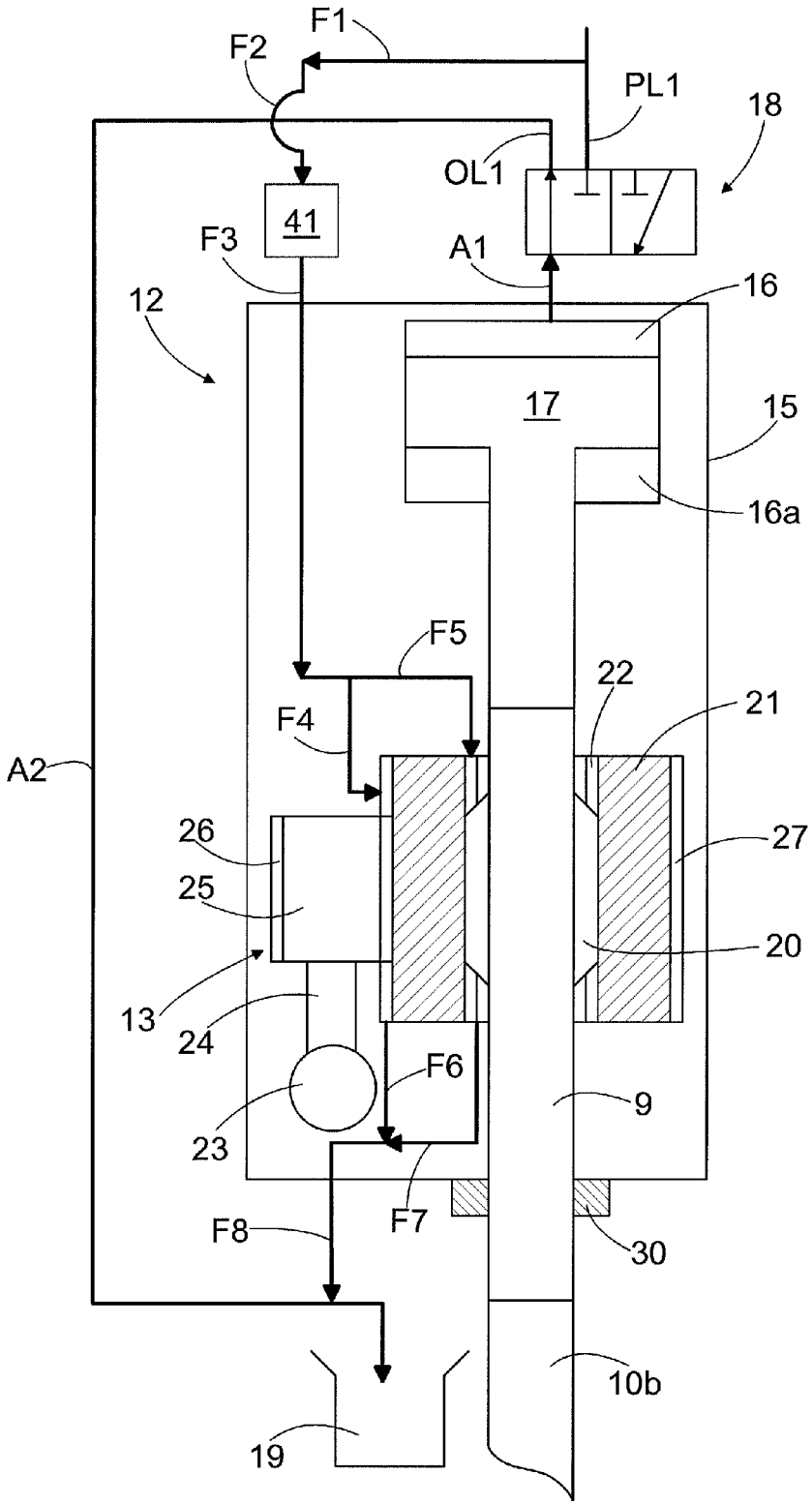
FIG. 9 is a schematic view of a seventh arrangement for lubricating the rotation mechanism of a drill shank of a rock drilling machine.

FIG. 9 is a schematic view of a seventh arrangement for lubricating the rotation mechanism of a drill shank 9 of a rock drilling machine 5. The solution shown in FIG. 9 is very similar to that of FIG. 3 with the exception, however, that pressure fluid entering the percussion device 12 is used to lubricate the rotation mechanism of the drill shank 9.

The lubrication of the rotation mechanism of the drill shank 9, that is, in the embodiment of FIG. 9, the lubrication between the splines 20 of the drill shank 9 and the grooves 22 on the inner circumference of the rotation bushing 21 and the lubrication between the gear ring 25 and the grooves 27 on the outer circumference of the rotation bushing 21, is arranged by means of the entry flow of the hydraulic circuit or percussion circuit of the percussion device 12. Part of the flow of the pressure fluid entering the percussion device 12 along the pressure line PL1 is directed toward the drill shank 9 as shown schematically by arrows F1 and F2. The embodiment shown in FIG. 9 further has a pressure-reducing unit 41 that may be a throttle or a pressure-reducing valve, with which the pressure of the pressure fluid may be reduced to a lower pressure level sufficient for lubrication purposes. After the pressure-reducing unit, the pressure fluid flows on in the manner shown by arrow F3 toward the drill shank 9, where the flow is divided into two sub-flows F4 and F5, and sub-flow F4 is directed to lubricate the connection between the gear ring 25 and the grooves 27 on the outer circumference of the rotation bushing 21, and sub-flow F5 is directed to lubricate the connection between the splines 20 of the drill shank 9 and the grooves 22 on the inner circumference of the rotation bushing 21. The flow exiting from the gap between the gear ring 25 and the grooves 27 on the outer circumference of the rotation bushing 21 is shown by arrow F6, and the flow exiting from the gap between the splines 20 of the drill shank 9 and the grooves 22 on the inner circumference of the rotation bushing 21 is shown by arrow F7. In the embodiment shown in FIG. 3, the sub-flows F6 and F7 are then combined into one flow F8 that is combined to the flow exiting the percussion device 12 shown by arrow A2 and directed to the pressure medium container 19. The advantages of the solution correspond to those described in connection with the description of FIG. 3.

In the solution of FIG. 9, the pressure fluid flow entering the percussion device 12, that is, the entry flow of the hydraulic circuit of the percussion device 12, is thus used in lubricating the rotation mechanism of the drill shank 9. Correspondingly, the pressure fluid flow entering the rotating device 13 or control unit 29 of the control valve 18 could also be used to lubricate the rotation mechanism of the drill shank 9, as could the pressure fluid brought to the flange 36 arranged to push the drill shank 9 away from the tool 10 of the rock drilling machine 5. The use of the pressure-reducing unit 41 is not necessary if the pressure level of the pressure fluid entering the device is at a suitable level even for the lubrication of the rotation mechanism of the drill shank.

In some cases, the features described in this application may be used as such, regardless of other features. On the other hand, the features described in this application may also be combined to provide various combinations as necessary. Thus, the control valve shown in FIG. 7 and/or the power transmission principle used in rotating the drill shank 9, for instance, can also be used as appropriate in the solutions of FIGS. 3 to 6 or 8 or 9.

The drawings and the related description are only intended to illustrate the idea of the invention. The invention may vary in its details within the scope of the claims. The figures and their descriptions present that both the lubrication between the splines 20 of the drill shank 9 and the grooves 22 on the inner circumference of the rotation bushing 21 and the lubrication between the gear ring 25 and the grooves 27 on the outer circumference of the rotation bushing 21 are arranged by means of pressure fluid flow exiting the same application site, but it is also possible to have an embodiment in which the lubrication of both lubrication sites are arranged by means of pressure fluid flows from different application sites or from more than one application site and/or by means of pressure fluid flows entering one or more application sites.

The invention claimed is:

1. A method for lubricating a rotation mechanism of a drill shank in a rock drilling machine, the method comprising:

directing to the rotation mechanism of the drill shank at least part of a flow of a pressure fluid of a hydraulic circuit of a device of the rock drilling machine that performs at least one function, for the purpose of lubricating the rotation mechanism of the drill shank, and circulating the pressure fluid used in lubricating the rotation mechanism of the drill shank back to a hydraulic system of the rock drilling machine, and then to the hydraulic circuit of the device of the rock drilling machine performing at least one function, wherein the pressure fluid used for lubricating the rotation mechanism of the drill shank is returned back to a pressure medium container that is in the hydraulic system of the rock drilling machine, and wherein the device of the rock drilling machine performing at least one function is a rotating device of the rock drilling machine.

2. A method as claimed in claim 1, wherein pressure fluid entering the device of the rock drilling machine performing at least one function is directed to the rotation mechanism of the drill shank for the purpose of lubricating the rotation mechanism.

3. A method as claimed in claim 2, wherein the pressure of the pressure fluid to be directed to the rotation mechanism of the drill shank is reduced before directing the pressure to the rotation mechanism of the drill shank.

4. A method as claimed in claim 1, wherein the rock drilling machine comprises a device arranged to push the drill shank away from a tool of the rock drilling machine.

5. A method as claimed in claim 4, wherein the operating pressure of the device arranged to push the drill shank away from the tool of the rock drilling machine is derived from an operating pressure of another device of the rock drilling machine performing at least one function.

6. A method as claimed in claim 4, wherein the operating pressure of the device arranged to push the drill shank away from the tool of the rock drilling machine is derived from a separate adjustable pressure medium source.

7. A method for lubricating a rotation mechanism of a drill shank in a rock drilling machine, the method comprising:

directing to the rotation mechanism of the drill shank at least part of a flow of a pressure fluid of a hydraulic circuit of a device of the rock drilling machine that performs at least one function, for the purpose of lubricating the rotation mechanism of the drill shank, and circulating the pressure fluid used in lubricating the rotation mechanism of the drill shank back to a hydraulic system of the rock drilling machine, and then to the hydraulic circuit of the device of the rock drilling machine performing at least one function, wherein the pressure fluid used for lubricating the rotation mechanism of the drill shank is returned back to a pressure medium container that is in the hydraulic system of the rock drilling machine, wherein the device of the rock drilling machine that performs at least one function is a percussion device or a rotating device, and wherein pressure fluid exiting the device of the rock drilling machine performing at least one function is directed to the rotation mechanism of the drill shank for the purpose of lubricating the rotation mechanism.

8. A method as claimed in claim 7, wherein pressure fluid entering the device of the rock drilling machine performing at least one function is directed to the rotation mechanism of the drill shank for the purpose of lubricating the rotation mechanism.

9. A method as claimed in claim 8, wherein the pressure of the pressure fluid to be directed to the rotation mechanism of the drill shank is reduced before directing the pressure to the rotation mechanism of the drill shank.

10. A method as claimed in claim 7, wherein the rock drilling machine comprises a device arranged to push the drill shank away from a tool of the rock drilling machine.

11. A method as claimed in claim 10, wherein the operating pressure of the device arranged to push the drill shank away from the tool of the rock drilling machine is derived from an operating pressure of another device of the rock drilling machine performing at least one function.

12. A method as claimed in claim 10, wherein the operating pressure of the device arranged to push the drill shank away from the tool of the rock drilling machine is derived from a separate adjustable pressure medium source.

13. An arrangement for lubricating a rotation mechanism of a drill shank of a rock drilling machine, in which arrangement at least part of a flow of a pressure fluid of a hydraulic circuit of a device of the rock drilling machine performing at least one function is arranged to be directed to the rotation mechanism of the drill shank for the purpose of lubricating it, and that the pressure fluid used in lubricating the rotation mechanism of the drill shank is arranged to circulate back to a hydraulic system of the rock drilling machine, and then to a hydraulic circuit of the device of the rock drilling machine performing at least one function, wherein the pressure fluid used for lubricating the rotation mechanism of the drill shank is returned back to a pressure medium container that is in the hydraulic system of the rock drilling machine, and wherein the device of the rock drilling machine performing at least one function is a rotating device of the rock drilling machine.

14. An arrangement as claimed in claim 13, wherein the pressure fluid directed to the rotation mechanism of the drill shank for lubricating it is arranged to be derived from the pressure fluid entering the device of the rock drilling machine performing at least one function.

15. An arrangement as claimed in claim 14, wherein the arrangement also comprises at least one pressure-reducing unit for reducing the pressure of the pressure fluid directed to the rotation mechanism of the drill shank before directing the pressure fluid to the rotation mechanism of the drill shank.

16. An arrangement as claimed in claim 13, wherein the rock drilling machine comprises a device arranged to push the drill shank away from a tool of the rock drilling machine.

17. An arrangement as claimed in claim 16, wherein an operating pressure of the device arranged to push the drill shank away from the tool of the rock drilling machine is arranged to be derived from an operating pressure of another device of the rock drilling machine performing at least one function.

18. An arrangement as claimed in claim 16, wherein the operating pressure of the device arranged to push the drill shank away from the tool of the rock drilling machine is arranged to be derived from a separate adjustable pressure medium source.

19. An arrangement for lubricating a rotation mechanism of a drill shank of a rock drilling machine, in which arrangement at least part of a flow of a pressure fluid of a hydraulic circuit of a device of the rock drilling machine performing at least one function is arranged to be directed to the rotation mechanism of the drill shank for the purpose of lubricating it, and that the pressure fluid used in lubricating the rotation mechanism of the drill shank is arranged to circulate back to a hydraulic system of the rock drilling machine, and then to a hydraulic circuit of the device of the rock drilling machine performing at least one function, wherein the pressure fluid used for lubricating the rotation mechanism of the drill shank is returned back to a pressure medium container that is in the hydraulic system of the rock drilling machine, wherein the device of the rock drilling machine that performs at least one function is a percussion device or a rotating device, and wherein the pressure fluid directed to the rotation mechanism of the drill shank for lubricating it is arranged to be derived from the pressure fluid exiting the device of the rock drilling machine performing at least one function.

20. An arrangement as claimed in claim 19, wherein the pressure fluid directed to the rotation mechanism of the drill shank for lubricating it is arranged to be derived from the pressure fluid entering the device of the rock drilling machine performing at least one function.

21. An arrangement as claimed in claim 20, wherein the arrangement also comprises at least one pressure-reducing unit for reducing the pressure of the pressure fluid directed to the rotation mechanism of the drill shank before directing the pressure fluid to the rotation mechanism of the drill shank.

22. An arrangement as claimed in claim 19, wherein the rock drilling machine comprises a device arranged to push the drill shank away from a tool of the rock drilling machine.

23. An arrangement as claimed in claim 22, wherein an operating pressure of the device arranged to push the drill shank away from the tool of the rock drilling machine is arranged to be derived from an operating pressure of another device of the rock drilling machine performing at least one function.

24. An arrangement as claimed in claim 22, wherein the operating pressure of the device arranged to push the drill shank away from the tool of the rock drilling machine is arranged to be derived from a separate adjustable pressure medium source.

* * * * *